United States Patent [19]

Dutton et al.

[11] 4,116,600

[45] Sep. 26, 1978

[54] SOLID PACK TUNA CANNING MACHINE

[75] Inventors: Edward E. Dutton, Whittier; Jack Gorby, Los Angeles, both of Calif.

[73] Assignee: Sea-Pac, Inc., Gardena, Calif.

[21] Appl. No.: 719,415

[22] Filed: Sep. 1, 1976

[51] Int. Cl.[2] ..... A23P 1/00; A22C 25/00

[52] U.S. Cl. ..... 425/296; 53/517; 100/218; 425/358

[58] Field of Search ..... 53/122, 123, 252; 426/518, 513, 397, 407; 425/356, 357, 358, 359, 360, 361, 362, 444, 305, 296; 100/218, 221, 223, 98 R

[56] References Cited

U.S. PATENT DOCUMENTS

| | | | |
|---|---|---|---|
| 2,037,724 | 4/1936 | Jacobs et al. | 53/123 |
| 2,041,060 | 5/1936 | Gardner | 53/123 |
| 2,542,133 | 2/1951 | Gorby | 426/518 |
| 2,630,390 | 3/1953 | Carruthers | 426/513 X |
| 2,926,095 | 2/1960 | Gorby | 53/123 |
| 3,124,469 | 3/1964 | Carruthers | 426/513 |
| 3,164,857 | 1/1965 | Sennello | 53/123 X |
| 3,501,890 | 3/1970 | Hunt | 100/218 |
| 3,585,925 | 6/1971 | Fox | 100/218 |
| 3,700,386 | 10/1972 | Mencacci | 53/123 |

*Primary Examiner*—Francis S. Husar
*Assistant Examiner*—William R. Briggs
*Attorney, Agent, or Firm*—Phillips, Moore, Weissenberger, Lempio & Majestic

[57] ABSTRACT

A fish-canning machine having two adjacent parallel rotary turrets each having a fish-receiving pocket in the periphery thereof. The turrets are positioned to align the pockets with each other to form a single combined pocket which is then filled with fish from a corresponding large size feed chute of increasing cross-sectional area. The fish in the pockets is severed between the turrets and the turrets are rotated by different amounts to move the filled pockets laterally out of alignment with each other. The fish in both filled pockets is formed into the shape of a can and ejected endwise from the pockets into two separate cans.

31 Claims 13 Drawing Figures

FIG _ 7
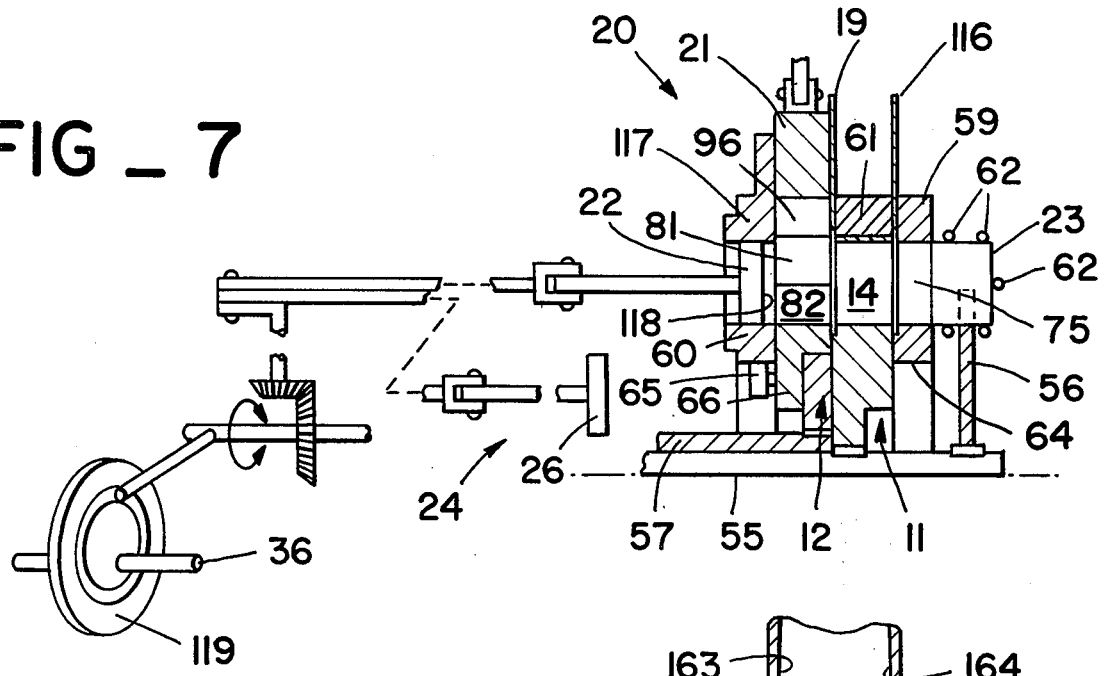
FIG _ 8
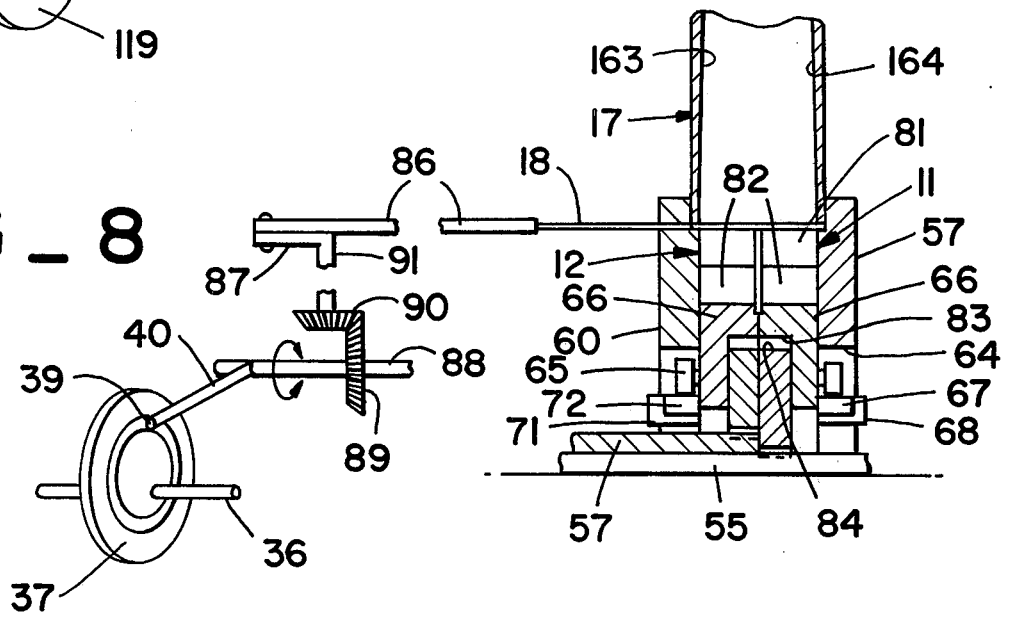
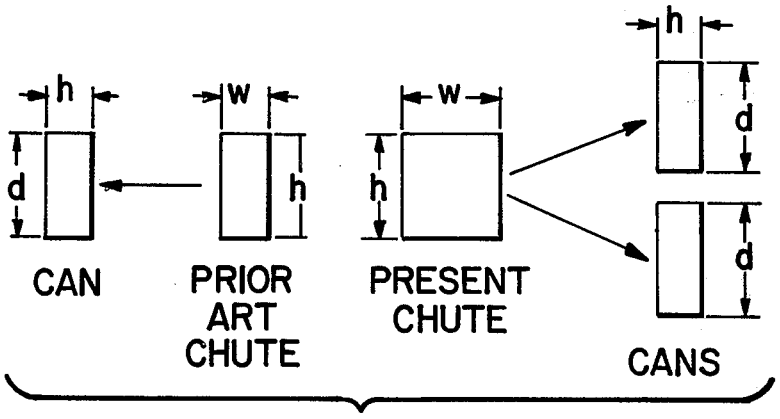
FIG _ 12

SOLID PACK TUNA CANNING MACHINE

BACKGROUND OF THE INVENTION

This invention relates to fish-canning machines and particularly to a turret type of solid pack machines such as shown in U.S. Pat. No. 2,542,133 to Gorby, wherein fish loins are moved down a feed chute and filled into metering pockets around the periphery of a rotating turret. The fish in the metering pockets is then compressed and formed into the shape of a can, the fish being then ejected into a can.

Although machines of this general type are used successfully in the fish-canning industry, they have several drawbacks which are of considerable importance to the canner.

First of all, these machines pack fish into one can at a time. The successive operations performed by the machine each take a discrete amount of time and the rate of production is thus dependent upon the length of time required to perform all of these steps. If the rate of production of a fishing packing plant is to be increased, additional machines, with all of their accessory equipment must be installed.

Secondly, the quality of pack is very important, particularly where solid pack tuna is involved. Grading and value of canned tuna are largely determined by the size and proportion of naturally adhering pieces of the original loin or fillet. Canned tuna in solid form, wherein each can contains a preponderance of solid pieces of the loin, constitutes the most generally available top-quality produce. In solid pack tuna the superiority of one pack over another is determined by the general appearance of the pack, the best quality of solid pack being that wherein the fish chunks are packed with the grain being vertical, and in which the chunks are undistorted by pressure and have the least amount of fragments and floating particles. Because of this, it is very desirable that a machine operate in such a manner as to minimize packing pressure and fragmentation of the loins during packing.

In machines of the type shown in the aforesaid U.S. Pat. No. 2,543,133, undesired fragmentation of the loins occurs quite often in the feed chute which leads to the metering pockets. The chute is necessarily restricted in size, since it must be related to the size of the metering pockets, and considerable drag exists between the walls of the chute and the fish therein. The ram which pushes the fish down the chute must exert a correspondingly large force on the fish to overcome this drag, and such force often distorts, mashes or crumbles the fish, detracting from the appearance and lowering the quality of the pack.

Thirdly, control of the weight per can is another important consideration in the use of automatic fish-canning machines. Governmental regulations provide that the labeled weight must be present in the canned product, sometimes on an average weight per half case of 24 cans and sometimes with respect to each can packed. With any automatic canning machine some variations in weight per can will inherently occur. To meet these regulations the machine will be set so that the average weight in the can is sufficiently above the labeled weight so that each can will have at least the labeled weight packed thereinto. If the weight control of the machine is poor, such that a relatively large variation in weight occurs from can to can, then many cans will have a considerable excess of fish. Such excess either represents a loss to the canner, or a loss to the consumer if the cost of the excess fish is passed on. The better the weight control per can, the less the amount of variable excess fish per can.

In machines as described above, weight control is typically accomplished by filling each metering pocket with the same volume of fish, the fish being compressed by as uniform a pressure as possible so that the density and weight per can will be constant. This compression force is supplied by the reciprocating ram in the feed chute.

As mentioned previously, a drag exists between the feed chute walls and the fish which must be overcome by the ram to feed the fish through the chute. This drag resistance varies somewhat during the course of a run. Since the ram force is used both to overcome a variable drag resistance and to compress the fish in the metering pocket, the variation in drag force will cause a variation in compression force and thereby affect the weight control. The greater the proportion of ram force used to overcome drag resistance to total ram force, the poorer the weight control.

Machines of the type having necessarily restricted-size feed chutes, have a considerable drag and a correspondingly poor weight control.

The effect of the variable drag on weight control can be reduced by increasing the total ram force so that the force required to overcome drag becomes a lesser portion of the total force. However, if this is done, then the likelihood of damage to the fish will increase. In addition, an increase in ram force will produce an adverse effect on another aspect of weight control, namely, the amount of fish protein that is to be packed into each can.

Fish flesh contains considerable protein-containing fluid which may be squeezed out of the flesh when the fish is subjected to pressure. An increase in ram force will increase the compression on the fish. If the compression becomes excessive, this fluid will be squeezed out in the chute or metering pockets and lost, so that the canned product will not meet the labelled weight. In such case, supplemental fish flesh must be added to the can. As a consequence, increasing the ram force in an effort to provide better control of the weight of fish per can will instead produce an adverse effect.

It is the principal object of the present invention to provide a fish-canning machine for solid pack tuna which will substantially increase the production capacity while at the same time enabling the production of a higher quality pack with better weight control and increased yield due to less fluid loss.

SUMMARY OF THE INVENTION

The principal object of the invention is achieved by providing two adjacent turrets rotating about a common axis, each having a number of metering pockets along the periphery thereof. The turrets are rotated to position one pocket of one turret in alignment with a pocket of the other at a first operational or feed station, the two pockets thus forming one large combined pocket. The feed chute, which discharges fish simultaneously into both pockets at the feed station, has twice the cross-sectional area but relatively little more wall surface as compared to the feed chute of an existing single-can machine. The feed chute is also shaped to provide an increasing cross-sectional area. A significantly lesser proportion of ram force is needed to overcome drag resistance and a significantly lesser pressure per square inch is exerted on the fish.

After the pockets are filled at the feed station, the fish is severed between the pockets to divide the fish therein into two masses, one in each pocket and each of an amount to fill a single can. The turrets are rotated relative to each other to move the pockets out of alignment with each other, with one pocket brought to rest at a second operational station. At the second and third station, the fish in each pocket is formed into a cylindrical shape to fit a can and is then ejected into two cans, the forming and ejecting the occurring simultaneously at each station.

The rotation of the turrets which move the filled pockets to the second and third stations also brings empty pockets into alignment with each other at the feed station, and these pockets are then filled while the forming and ejecting operations are carried out on the filled pockets at the second and third stations.

The present invention produces two cans per cycle of operation is compared to the existing production of one can per cycle of operation and thus greatly increases the rate of production per machine, while at the same time improving quality, weight control and yield to the canner.

Other objects and advantages will become apparent in the course of the following detailed description.

BRIEF DESCRIPTION OF THE DRAWINGS

In the drawings, forming a part of this application, and in which like parts are designated by like reference numerals through the same:

FIG. 7 is a sectional view, taken on line 7—7 of FIG. 3, illustrating one of the knock-out plungers and, schematically the operating mechanisms for the knock-out plungers;

FIG. 8 is a sectional view taken on line 8—8 of FIG. 3, illustrating the volume knife and, schematically, the operating mechanism therefor;

FIG. 12 compares dimensions of a prior art feed chute and the feed chute of the present invention.

DESCRIPTION OF THE PREFERRED EMBODIMENT

Figure 1:
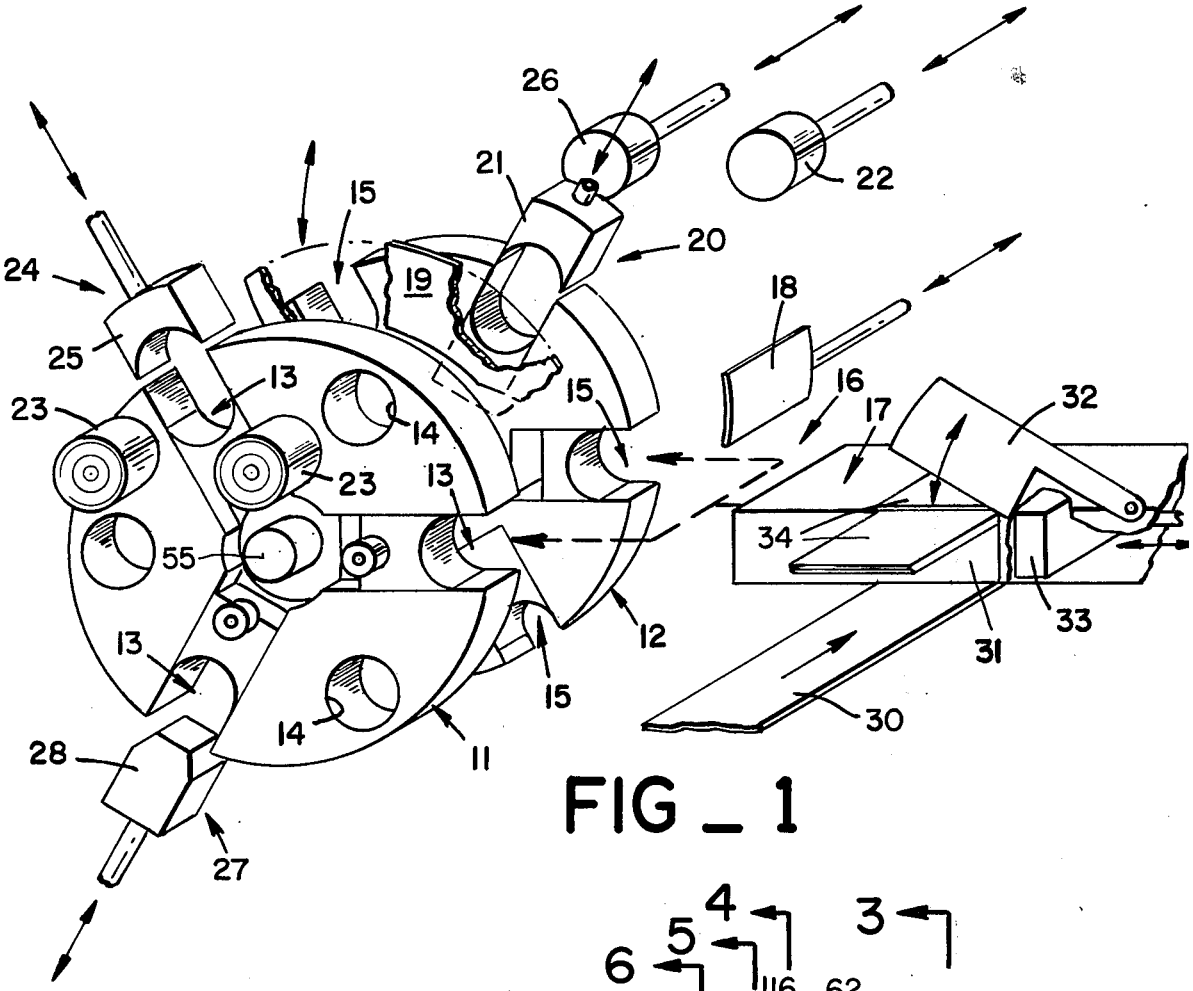
FIG. 1 is a schematic exploded view of the rotatable turrets and the operational stations around the peripheray thereof.

Referring to the drawings, wherein a preferred embodiment of the invention is shown, and in particular to FIG. 1, the fish-canning machine comprises a pair of rotatable turrets 11 and 12 mounted for rotation about a common axis. Turret 11 has three fish-receiving pockets 13 spaced equidistantly therearound and openings 14 between each pair of adjacent pockets. Turret 12 has six equidistantly spaced fish-receiving pockets 15 around the periphery thereof. When the turrets are positioned as in FIG. 1, every other pocket 15 of turret 12 is in axial alignment with a pocket 13 of turret 11 and each of the other pockets 15 of turret 12 is in axial alignment with one of the openings 14 through turret 11.

Three operating stations are spaced around the periphery of the turrets. The first or feed station 16 comprises the feed chute 17 and a reciprocating volume knife 18 which moves between the end of the feed chute 17 and the peripheries of turrets 11, 12. A pivotal divider knife 19 is mounted on an axis parallel to that of the turrets for in-and-out movement between the turrets to sever fish that have been fed into the pockets at station 16.

A second operating station 20 comprises a former plunger 21 mounted for reciprocatory movement radially of turret 12 into and out of a pocket 15 of turret 12, and a knock-out plunger 22 mounted for reciprocatory movement along a line parallel to the turret axis and adapted to move axially into and through a pocket 15 of turret 12 and the aligned opening 14 of turret 11 to eject fish into a can 23 and then move out of the opening 14 and pocket 15.

The third station 24 is similar to the second station and includes a former plunger 25 of turret 11 and a knock-out plunger 26 adapted to move through aligned pockets of the turrets to eject fish from a pocket of turret 11 into another can 23.

If desired, a fourth operating station 27 may be provided, this station comprising a lock plunger 28 movable radially of the turrets into and out of aligned pockets of the turrets thereat for locking the turrets against rotation. This station is necessary only if the indexing drive for the turrets does not itself provide sufficient locking of the turrets in the dwell period between rotation of the turrets from the first station to the second and third stations.

The present apparatus further includes a conveyor belt 30 which delivers fish loins to the feed chute 17, the loins entering the chute through the side opening 31 thereof. A loin knife 32 is positioned to move down across the side opening 31 and sever the loins fed into the chute, the loins then being moved down the chute towards the turrets by ram 33. A vertically movable tamper 34 facilitates entry of fish loins into the feed chute.

Figure 2:
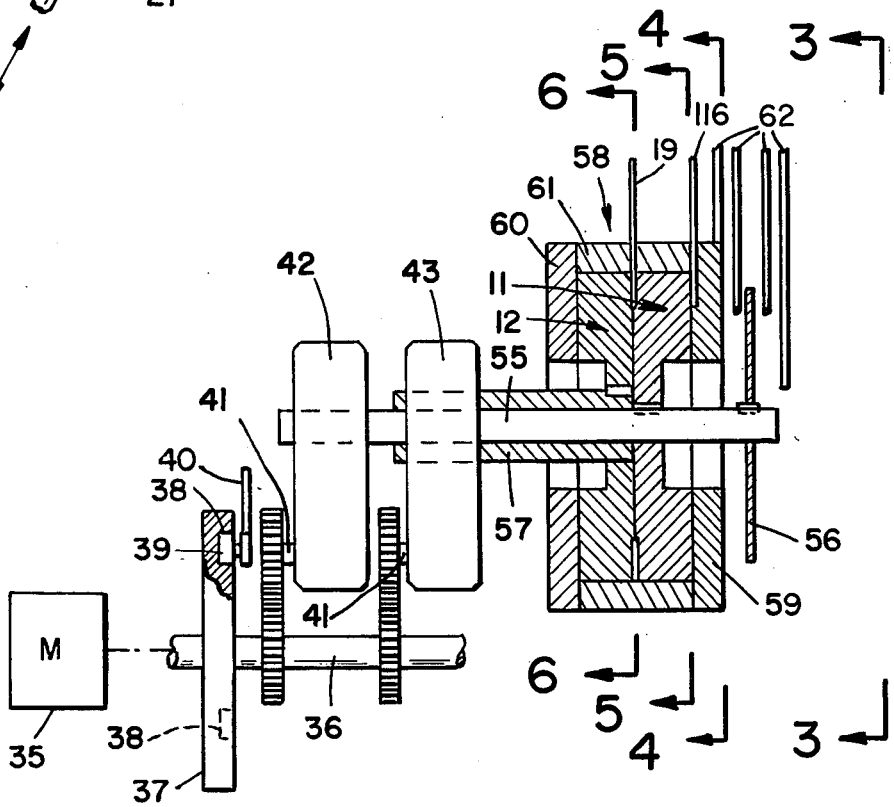
FIG. 2 is a sectional view in elevation of a portion of the machine, illustrating the turrets and drive mechanisms therefor.

Referring now to FIG. 2, the machine includes a motor 35 suitably arranged to drive the main shaft 36 which is conventionally journaled in the frame of the machine for rotation. Positive cam 37, shown in FIG. 2, is illustrative of the various cams which are mounted on the main drive shaft 36 for rotation therewith, the cams being used to actuate the various elements of the machine. Cam 37 has a cam track 38 in the face thereof in which cam roller 39 rides the movement of the roller 39 towards and away from the axis of shaft 36 in turn causing a movement of the cam follower arm 40 on which the roller is mounted.

Shaft 36 is also coupled to the input shafts 41 of the two indexing drive units 42 and 43. Shaft 55 is the output shaft of indexing drive unit 42 and has turret 11 and can star 56 splined thereon. Shaft 57, coaxial to the surrounding shaft 55, is the output of indexing drive unit centering the turrets and locking them both against rotation.

Figure 5:
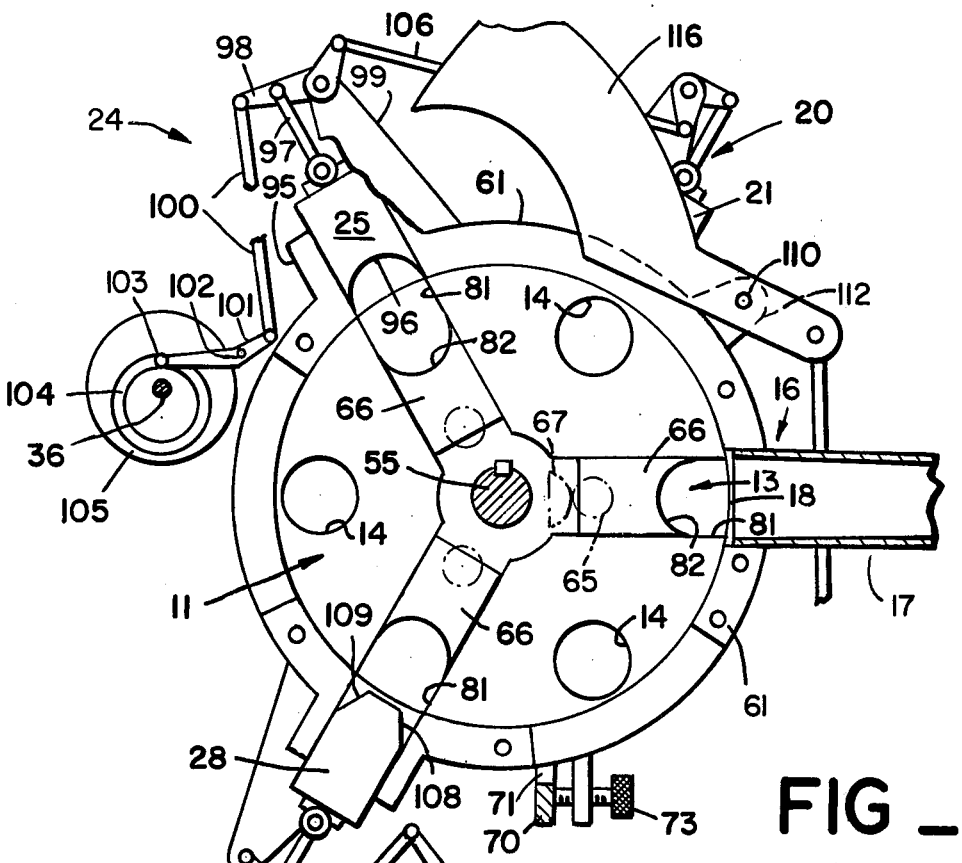
Figure 6:
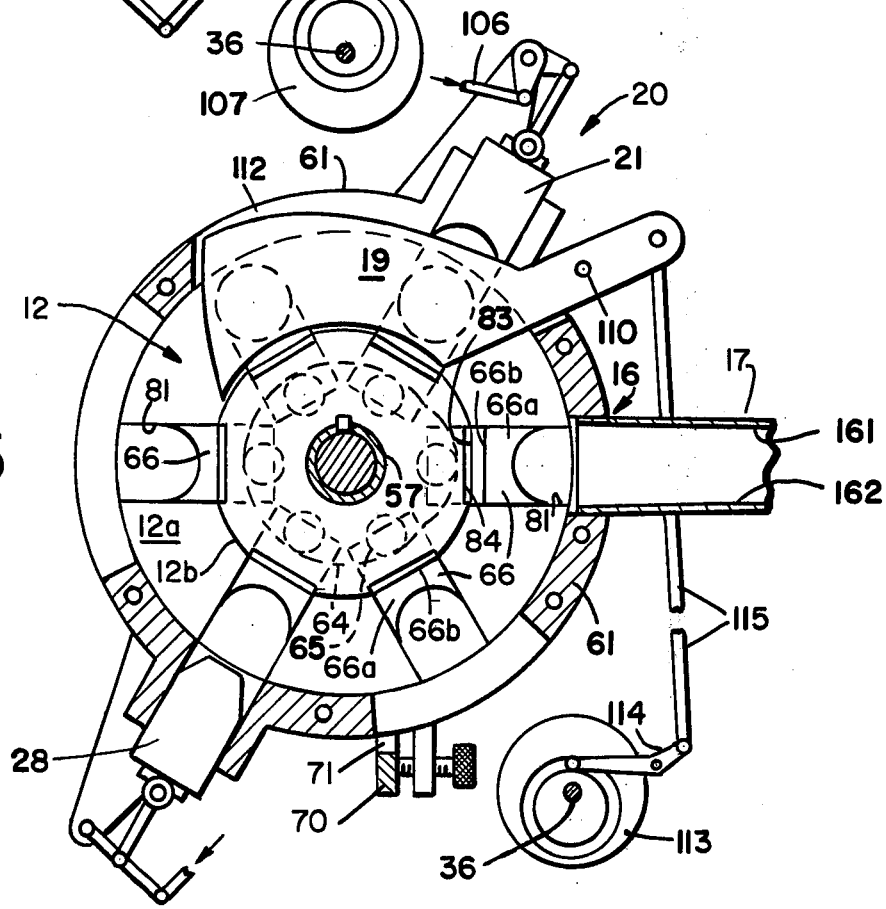

Referring now to FIGS. 5 and 6, the divider knife 19 is pivotally mounted at 110 to housing member 111 for movement in a plane between the turrets and normal to the axis of the turrets, between the extreme positions shown in FIGS. 7 and 8, the housing wall being slotted at 112 to allow such movement. The face 12*a* of turret 12 is cut away outwardly from shoulder 12*b* thereon, and the adjacent face of turret 11 is similarly cut away to allow the divider knife 19 to move therebetween. The face 66*a* of the metering shoes 66 are similarly cut away outwardly from shoulders 66*b* thereof, so as to be flush with the turret faces and to enable the blade of knife 19 to move therebetween. The divider knife is actuated by rotation of cam 113 on main shaft 36, movement to the knife being imparted by the action of the pivotally mounted cam follower lever 114 and link 115.

Dead plate 116, shaped the same as divider knife 19, is also mounted on shaft 110 for pivotal movement in unison with knife 19. The inner side of the housing end plate 59 is cut away to allow the dead plate to move between the end plate 59 and the adjacent face of turret 11.

As may be seen from FIG. 7, the knock-out plunger 22 at operating station 20 is mounted in guide collar 117 on housing plate 60 for reciprocal movement in a direction parallel to the axis of the turrets. The forward face 118 of plunger 22 has a diameter complementary to the surface 82 of shoe 66 and the surface 96 of former plunger 25. Cam 119 on main shaft 36 in connection with the operation of the volume knife; the cam, linkage and gearing being designed such that the knock-out plunger will move through a stroke slightly more than the combined thickness of the turrets and the housing wall 59. As illustrated schematically, the same cam 118 will reciprocate the knock-out plunger 22.

Figure 9:
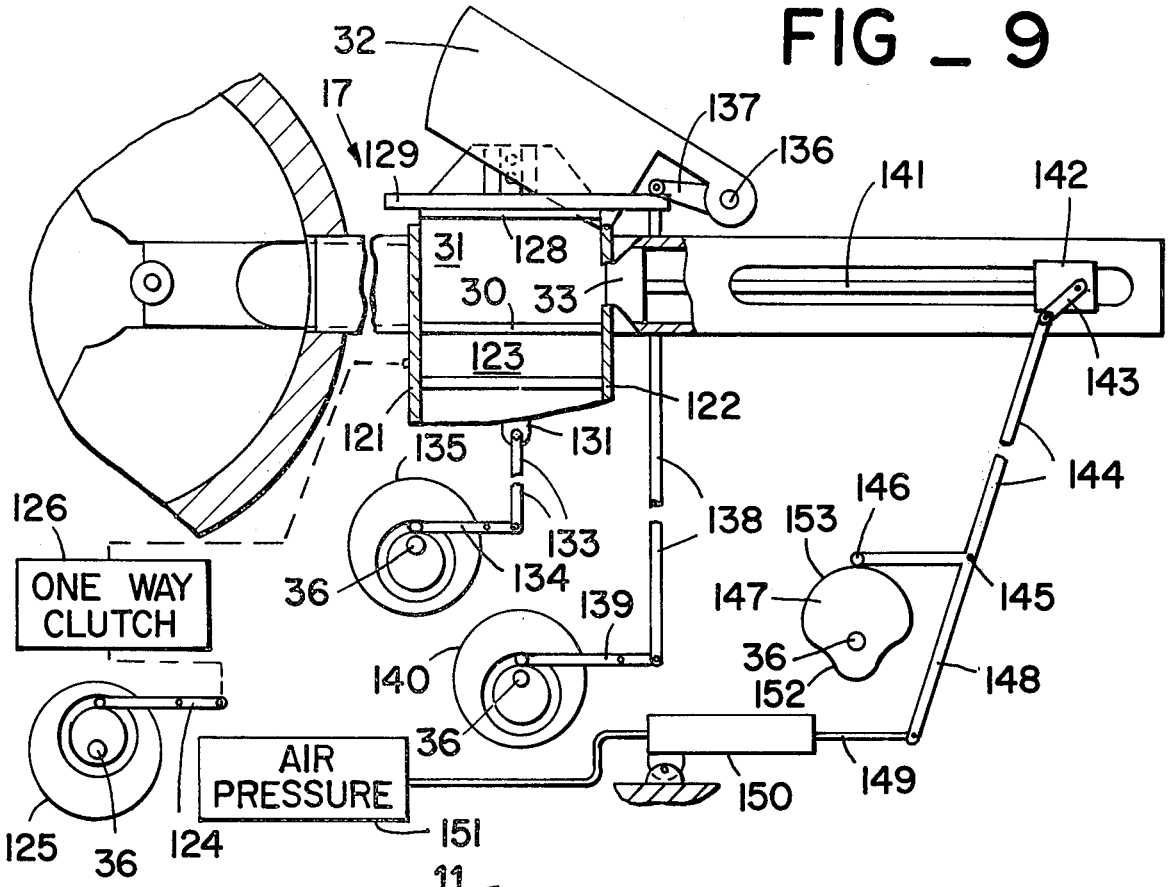
FIG. 9 is an elevational view partly in section of the fish feed chute, conveyor, tamper, loin knife, ram and, schematically, the operating mechanism therefor.
Figure 10:
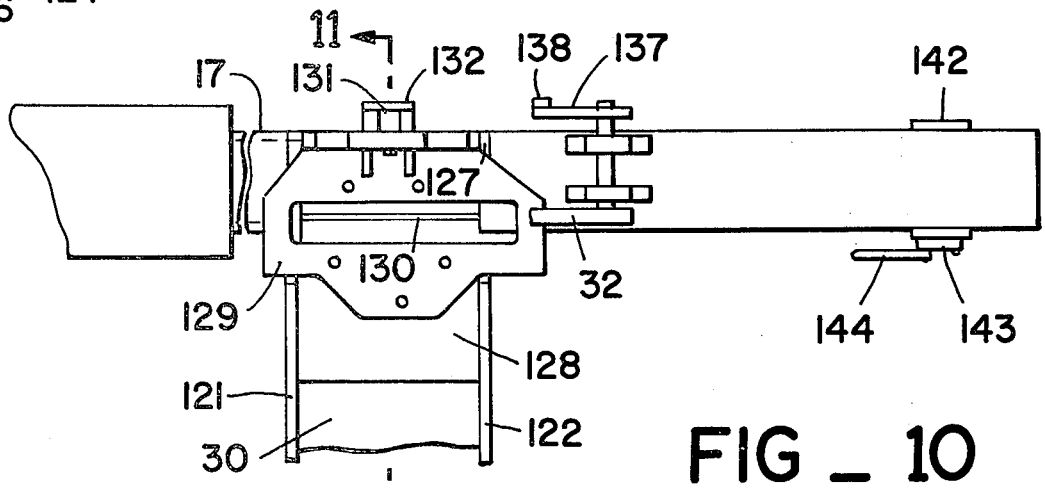
FIG. 10 is a plan view of the apparatus shown in FIG. 9.
Figure 11:
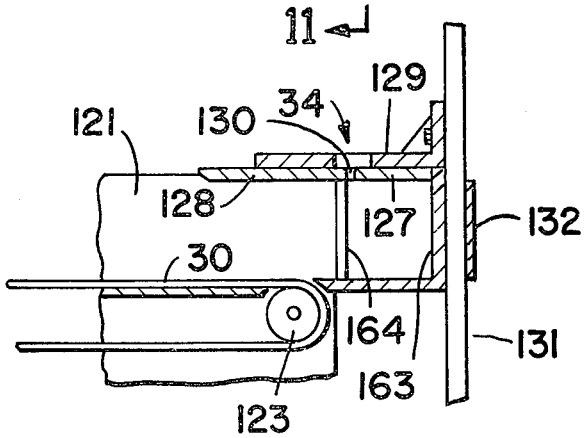
FIG. 11 is a sectional view taken on line 11—11 of FIG. 10.

Turning now to FIGS. 9–11, the conveyor belt 30 is disposed between vertically extending side plates 121 and 122 and trained around drive roller 123 so that the upper flight of the conveyor belt is adjacent the side entrance 31 of the feed chute 17. Drive roller 123 is periodically rotated in a direction to advance the belt, in response to motion of cam follower lever 124 produced by cam 125 and delivered to the belt through one-way clutch 126.

Generally horizontal tamper 34 is spaced vertically above the bottom of the side entrance 31 and comprises a first portion 127 extending transversely of the entrance and forming the top of feed chute 17 adjacent the side entrance 31 and a second portion 128 extending transversely of and outwardly from the feed chute to overlie the conveyor belt 30, the two portions being secured together for unitary movement by yoke 129, the two portions being horizontally spaced to leave a slot 130 therebetween. Yoke 129 is secured to vertical post 131 which is confined for vertical movement in sleeve 132 and is connected by link 133 to cam follower lever 134. Rotation of cam 135 will cause tamper 34 to move up and down once for each revolution of main shaft 36.

Loin knife 32 is fixed to shaft 136 for pivotal movement down through slot 130 and across the side entrance 31 of the feed chute. Crank arm 137 is also fixed to shaft 136 and is connected by link 138 to cam follower lever 139 for actuation by cam 140 on shaft 36.

Ram 33 is connected by rod 141 to slide block 142. Link 143 pivotally connects between slide block 142 and one end of bell crank 144, the latter being pivotally mounted on the frame at 145 and having a cam follower roller 146 in engagement with the face of open cam 147. Bell crank 144 has an extension arm 148 connected to piston rod 149 of pneumatic cylinder 150, the cylinder being supplied with air pressure from a constant pressure source 151. As cam 147 rotates to a position wherein its recessed face 152 is adjacent cam follower roller 146, bell crank 144 will rotate in a counterclockwise direction, under the force of the air pressure in cylinder 150 to move piston 33 to the left. Since the air in cylinder 150 is maintained at a constant pressure, ram 33 will exert a constant force on the fish in the feed chute regardless of the length of the stroke of ram 33. Continued rotation of cam 147 will bring its outer face 153 into engagement with roller 146, pivoting crank 144 in a clockwise direction to retract the ram to the position illustrated in FIG. 9.

As seen in FIGS. 5 and 8, the opposed inner surfaces 161 and 162 of the top and bottom walls of the feed chute 17 are tapered to diverge slightly as they extend away from the side entrance 31 of the feed chute toward the turrets 11 and 12. The opposed inner surfaces 163 and 164 of the side walls of the feed chute are similarly tapered. As a consequence, the rectangular cross section of the feed chute increases in size along the length thereof towards the turrets. The taper angle should be sufficiently great so as to result in a desired decrease in sticking while not being so great as to allow fish to extrude into the gap between the ram and chute. If desired, the chute could be stepped instead of tapered to provide the increase in size.

For purposes of illustration, the main shaft 36, with the various operating cams thereon, has been shown in different physical locations relative to the operating parts of the machine, and simplified linkages have been shown connecting the cams to the operating mechanisms. In an actual machine the cams would rotate on a common axis in a single shaft 36 with conventional motion transmitting linkages being employed to produce the results described hereinabove. If desired, the main shaft 36 could comprise two or more parallel shafts, driven in unison by conventional gearing or chain drives so as to locate the various cams thereon in closer proximity to the elements which are to be driven thereby.

Operation

Figure 13:
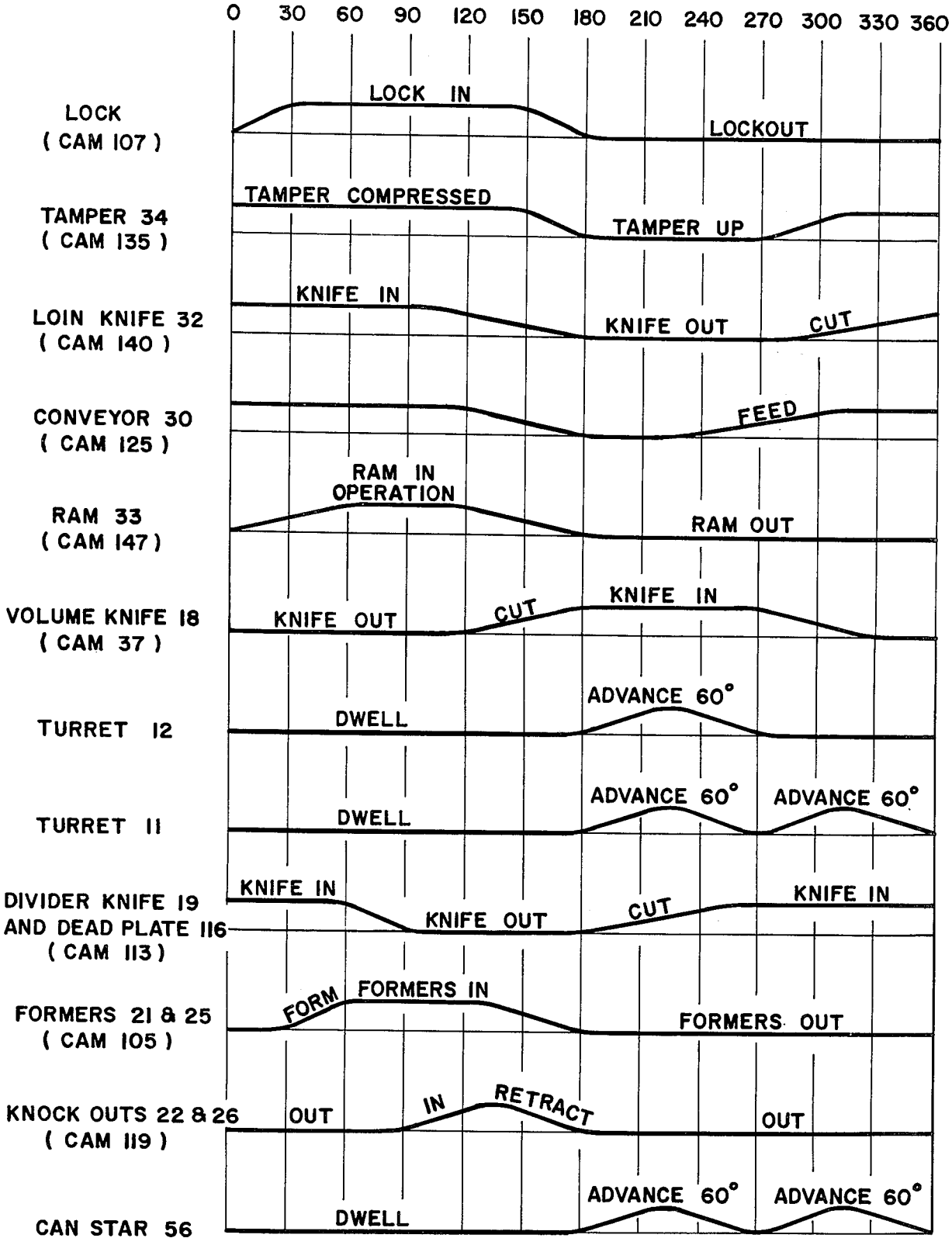
FIG. 13 is a timing chart illustrating the sequence of operation of the various components of the present machine.

The sequence of operations can best be described by reference to FIG. 13, which shows the operations of the various components of the machine during a single revolution of the main drive shaft 36.

At the zero reference point, an empty pocket of each turret will have just been rotated to the feed station, these pockets and their side entrances being aligned to form a single combined pocket having an unobstructed common entrance thereinto. A new supply of fish loins will have been fed by conveyor 30 into the feed chute, the tamper 34 will be down and the loin knife will have descended, cutting the loins and closing the side entrances of the feed chute 17. If used, lock cam 107 will now actuate the turret lock, causing the lock plunger 28 to enter a pocket of each turret, indexing and locking the turrets against rotation.

The ram control cam 147 will now allow ram 33 to be moved by the air pressure in cylinder 150 so that the ram comes into engagement with the column of fish loins in the chute, the ram then forcing the loins down 43 and has turret 12 spline connected thereto. Shafts 55 and 57 are suitably journaled in the frame of the machine for rotation about a fixed and common axis.

The function of the illustrated indexing drive unit 42 is to rotate output shaft 55 and advance turret 11 and can star 56 through two successive 60° increments for each complete revolution of main shaft 36, such rotation taking place during 180° rotation of shaft 36. Indexing drive unit 43 rotates output shaft 57 and advances turret 12 through a single 60° increment for each complete revolution of shaft 36, such rotation occurring during 90° rotation of shaft 36. The indexing units hold shafts 55 and 57 at their indexed position during the remaining portions of a single revolution of shaft 36. Indexing drive units for intermittant stepwise advance, as described above, are commercially available, and are accordingly not described in detail. For example, indexing drive units as used in the present invention are obtainable from Ferguson Machine Company of St. Louis, Mo.

Turrets 11 and 12 are enclosed by stationary housing 58, the housing having opposed end plates 59 and 60 adjacent the faces of the turrets. An arcuate wall 61 covers a portion of the peripheries of the turrets, leaving the remainder of the peripheries exposed for cleaning purposes. Housing 58 is suitably fixed to the frame of the machine.

Figure 3:
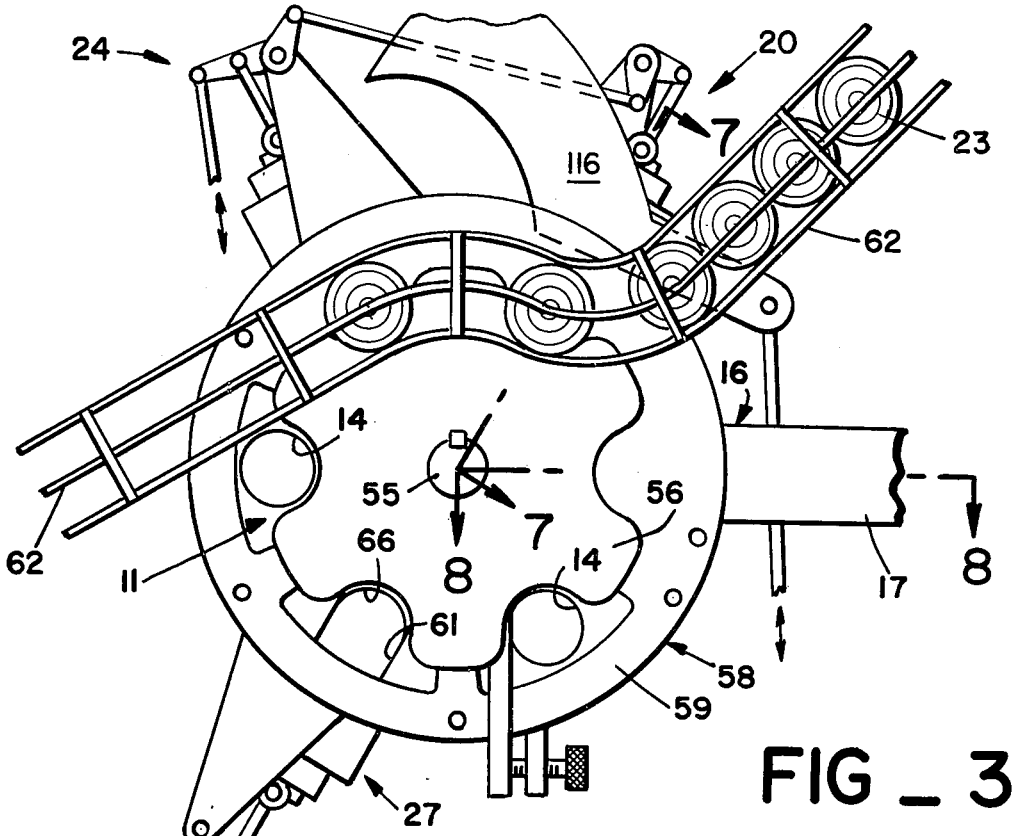
FIG. 3 is a front-elevational view of the turret portion of the machine as seen from line 3—3 of FIG. 2.

Referring now to FIG. 3, a can guide 62 mounted in fixed relation to the machine and housing 58 thereof delivers empty cans 23 to the six-lobed can star 56. The can star operates in a conventional manner to take the empty cans, one-by-one, carry them around the exterior of housing plate 59 and then discharge the cans down the can guide. Since can star 56 is fixed to shaft 55, it will rotate in unison with turret 11 through two 60° increments for each full revolution of the main shaft 36, taking up and discharging a can on each 60° increment of rotation thereof.

Figure 4:
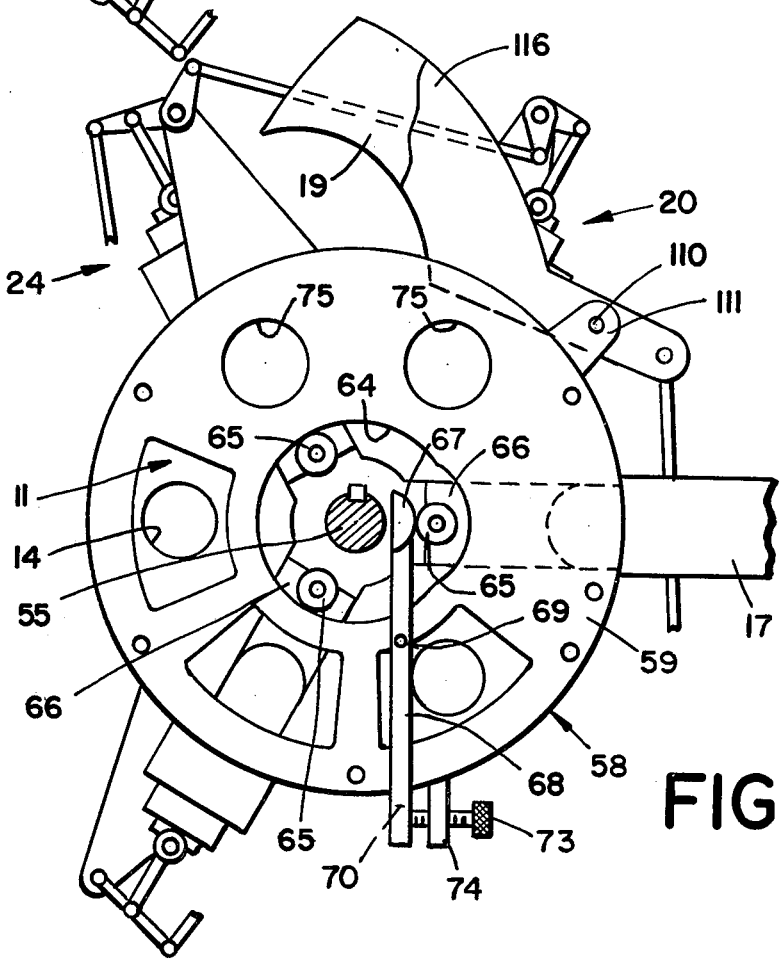
FIGS. 4, 5 and 6 are sectional views similar to FIG. 3 and taken on lines 4—4, 5—5 and 6—6, respectively, of FIG. 2 with drive mechanisms for the various operating stations being shown schematically in FIGS. 5 and 6.

As seen in FIG. 4, end plate 59 of housing 58 has a central opening forming a bearing surface 64 for the rollers 65 on the metering shoes 66 carried by turret 11. The distance from the axis of shaft 55 of bearing surface 64 is constant throughout the length of the bearing surface except at the side thereof adjacent the feed station 16 wherein the distance is increased. A volume cam 67, positioned to engage rollers 65, is mounted on lever arm 68 which is pivotally mounted at 69 on housing plate 59. Cross bar 70 on the lower end of lever arm 68 extends to a similar lever arm 71 (FIG. 10) pivotally mounted on housing plate 60, the latter lever arm having a volume cam 72 on the upper end thereof to engage the rollers on the metering shoes carried by turret 12. Adjustment screw 73, threaded through housing member 74, bears against cross bar 70 and enables the volume cams 67 and 72 to be positioned simultaneously at a desired distance from the axis of the turrets.

Housing plate 59 is also provided with two circular openings 75 therethrough, each opening having a diameter approximately equal to the can diameter, one opening being at operating station 20 and the other at operating station 24.

Housing plate 60 is the same as plate 59, having openings and a central roller bearing surface in alignment with the corresponding openings 75 and bearing surface 64 of housing plate 59.

Referring now to FIGS. 5 and 8, turret 11 has three slots 81 extending radially inwardly from the turret periphery, the slots being spaced equidistantly around the periphery of the turret and forming guideways for the metering shoes 66 which are radially slidable therein. Turret 12 is similarly formed, with six slots for the six metering shoes 66 carried thereby. Each metering shoe 66 has an outer concave end 82 of a curvature slightly less than that of can 23, and a thickness equal to the thickness of the turret and slightly less than the height of the can 23. Movement of the shoes inwardly toward the axis of the turrets is limited by engagement of the inwardly facing shoulder 83 on the shoe with the outwardly facing step 84 in a slot 81. Thus, as each turret rotates to bring a metering shoe 66 to the feed station 16, the adjustable volume cams 67 and 72 will engage the rollers 65 to force the metering shoes outwardly at a desired distance from the axis of the turrets. As the turrets rotate to move the metering shoes away from the feed station, the rollers 65 will leave the volume cams and engage the bearing surfaces 64 on the housing plates to move the shoes inwardly until they bottom out on the slot steps 84.

Each slot 81 and metering shoe 66 therein forms a pocket 13 in the periphery of the turret 11, the pocket having an axis parallel to the axis of shaft 55 and a rectangular side opening through the turret periphery, the dimensions of the side opening being slightly less than that of the diameter and height of a can 23.

Still with reference to FIG. 5, the feed chute 17 extends through the housing wall 61, with the discharge end of the feed chute being spaced from the turrets sufficiently to allow the volume knife 18 to move therebetween. As shown in FIG. 8 the volume knife, which is mounted in suitable stationary guides (not shown) for reciprocal movement therein, has an actuating arm 86 connected to crank 87. Rotation of cam 37 on main shaft 36 causes shaft 88 to oscillate about its fixed axis, such movement being transmitted, as for example through bevel gears 89 and 90 to crank shaft 91 to cause the desired reciprocal movement of the volume knife. The drive transmission is designed so that rotation of cam 37 will cause the volume knife 18 to move through a distance slightly more than the combined width of turrets 11 and 12.

Referring still to FIG. 5, operating station 24 includes a former plunger 25 which is mounted in housing boss 95 for movement radially of turret 11, former 25 having a concave inner surface 96 complementary in shape to the concave outer surface 82 of metering shoe 66. Former plunger 25 has an actuating arm 97 connected to bell crank 98, the latter being pivotally mounted on housing member 99. Link 100 extends from bell crank 98 to lever 101 which is pivotally mounted at 102 to the frame of the machine and has cam follower 103 thereon in engagement with cam track 101 of cam 105 which is fixed to the main drive shaft 36. The cam 104 and the drive transmission are designed so that for every revolution of the drive shaft 36, the former plunger 25 will be forced into a pocket 13 to form fish therein into the shape of a can 23, the plunger then being retracted from the pocket so that turret 11 may then rotate. A drive link 106 is also connected to bell crank 98 and actuates a similar linkage to move former plunger 21 into and out of a pocket in turret 12 in synchronism with movement of former plunger 25.

Lock plunger 28 is similarly mounted for movement radially of the turrets and is actuated by a similar drive transmission in response to rotation of cam 107 on main shaft 36. As plunger 28 moves inwardly, the tapered sides 108 and 109 engage the slots 81 of both turrets, the chute and into the turret pockets with a force determined by the air pressure within the ram cylinder. Since the fish loins are essentially homogeneous in composition, the constant force thereon from the pneumatically operated ram is used to produce a uniform density and weight of fish in the turret pockets for each cycle of operation even though the initial amount of fish in the feed chute and the length of the stroke of the ram during filling may vary.

After the fish has been forced into the turret pockets, the volume knife cam 37 causes volume knife 18 to enter between the pocket entrances and the feed chute to sever the column of fish loins and form a single slug of fish in the combined pockets, the slug having a weight and length twice that needed to fill a single can 23.

At this time, the turret lock plunger 28 will be retracted. The indexing drive units 42 and 43 will cause both turretts 11 and 12 to be advanced simultaneously through a 60° increment, so that both filled pockets are brought to the second station 20. During this time cam 113 causes divider knife 19 to descend between the pockets, the knife coming to rest at its full inward position at the end of the 60° rotation of the turrets. The relative movement of the knife and the rotating turret pockets provides a clean severing and division of the slug of fish in the pockets and forms a charge of fish in each pocket which has a length and weight equal to that required to fill a single can 23. At the same time, dead plate 116 descends between turret 11 and end plate 59.

Indexing drive unit 42 then moves turret 11 through another 60° advance, so that the filled pocket 13 thereof is brought to the third station 24.

During these successive periods of turret rotation, tamper 34 will be raised and loin knife 32 will be moved upwardly to open the side entrance into the feed chute. The conveyor 30 is actuated to advance a new charge of fish loins into chute 17 and replenish the column of fish therein for the next cycle of operation. Tamper 34 will be lowered and loin knife 32 will be swung down to sever the fish loins and again close the side of the chute.

At the start of a full cycle of operations as described above, a filled pocket of each turret will have been positioned at each of the second and third stations 20 and 24 as a result of the preceding cycle of operations of the machine.

The former cam 105 actuates both former plungers 21 and 25, causing them to enter into the side entrances of the filled pockets at the second and third stations and compress the fish into cylinders slightly smaller in diameter than the cans 23 into which the fish is to be packed. As the fish in pocket 15 of turret 12 is being formed, it is confined between knockout plunger 22 and divider knife 19 so that it is held from axial extrusion from the pocket. Similarly, the fish in pocket 13 of turret 11 is confined between divider knife 19 and dead plate 116 for the same purpose. The divider knife 19 and dead plate 116 are now retracted and the knockout cam 119 causes the two knockout plungers 22 and 26 to enter endwise into the pockets and force the compressed cylinders of fish into the waiting cans. The holes 14 in turret 11 and holes 75 in the end plate 59 are slightly larger than the compressed cylinder of fish so as not to impede movement of the fish from the forming pockets at the cans.

The knock-out plungers and formers are now retracted from the turrets, so that the turrets may then be advanced. Since the can star 56 is connected to turret 11 for rotation therewith, the can star will rotate 120°. On each 60° increment of rotation a filled can will be stripped therefrom and an empty can will be picked up thereby in readiness for the next full cycle of operation.

The speed of operation of a turret-type fish-canning machine, whether it be of the kind as hereinbefore described wherein one can is packed at a time or, as here, where two cans are packed at once, is inherently limited by the length of time it takes for the performance of the various steps which must be carried out in a proper sequence. At the feed station, it takes time to charge fish loins into the chute, to cut off the fish, to retract the ram and to open the chute.

In the present invention, twice the volume of fish loins is filled into the pockets in a single cycle of operation and consequently twice the volume of fish loins must be delivered by the conveyor belt and entered into the feed chute. However, since such loin feed only uses a relatively small fraction of a total cycle of operation, this is not a significant limitation on the speed of the machine. Moreover, the operation of the tamper 34 of the present invention ensures that the feed chute will be properly and rapidly filled in the short time allotted for such operation.

Fish loins will be piled on the conveyor belt ahead of the tamper to form a layer having a depth approximately equal to the height of the tamper portion 128 when in the raised position, or somewhat in excess thereof. As the layer is advanced by the conveyor belt, the forward edge of the tamper portion 128, which is raised during such advance, will strike off the excess to level the layer and allow the fish layer to advance beneath the tamper. In the period of time between operations of the conveyor, the tamper portion 128 will be moved downwardly to precompress the fish loins on the conveyor before they reach the feed chute which ensures that there will be minimal voids in the layer as it approaches the feed chute. The tamper will then be raised before the next advance of the conveyor belt, so that the tamper portion 128 will again allow the loins to pass easily thereunder. At the same time, the tamper portion 127 is raised to enlarge the opening into the feed chute so that the forward edge of the fish layer can advance easily into the feed chute. The conveyor again stops and the tamper is moved downwardly so that both tamper portions again press downwardly on the layer. At this time, the loin knife 32 is actuated to sever the fish layer. The compression of the layer by the tamper facilitates a clean cut thereof by the knife.

Preferably the bottom surface of tamper portion 127 is somewhat vertically above the bottom surface of tamper portion 128 for two reasons. First, such disposition will prevent the layer from hanging up when it is advanced from beneath tamper portion 128 to beneath tamper portion 127. Secondly, the downward force on the fish loins in the chute will be less than the precompression force caused by tamper portion 128 so that the loins, after severing, may be more easily moved by ram 33. Also, when tamper portion 127 is in its lowered position, the bottom surface of this tamper portion is slightly below the level of the top of the feed chute, so that the severed portion of the loins may be moved by ram 33 down the feed chute without hanging up.

A considerable amount of time in a cycle is required to force the fish lengthwise through the chute and into the pockets, with the fish being held under pressure by the ram while the fish is severed between the pockets and chute, and then retracting the ram. However, since the distance that the ram has to move is the same for a single pocket machine as for one having two axially aligned pockets, the only portion of this part of the operation that requires addiditional time in the present invention is the severing, since the volume knife must cut through twice the distance. This additional time, though, is very little and is more than off-set by the decrease in time needed to move the fish through the larger-sized chute, as brought out below.

At stations 20 and 24, the same time is required for the two formers to enter the pockets and form the fish therein as in a single-can machine. The simultaneously moving knockout plungers of the present invention must have a longer stroke than in a single-can machine, but since this action can be of relatively short duration, the total time for the cycle of operation is not appreciably affected.

As far as the turret rotation is concerned, the present invention does require a longer portion of an operating cycle as compared to single-can machines, i.e., the time required for turret 11 to rotate the additional 60°. However, with essentially the same length of time utilized for forming and ejecting, an increase by one-third of the time for a full cycle of operation for the additional 60° of turret rotation enables the production in cans per minute to be doubled.

In addition to this significant increase in production, the present invention enables the fish to be packed with considerably less damage thereto. In machines of this general type, the cross-sectional area and dimensions of the feed chute are related to the area and dimensions of the pockets and cans as illustrated in FIG. 12. For a prior art, single-can machine, the area of the feed chute is equal to the entrance area of the pocket, and the height and width of the chute are approximately equal to the diameter and height, respectively, of the can. The length of the periphery of such a chute is accordingly equal to approximately twice the diameter of the can plus twice the height of the can.

In the present invention, the cross-sectional area of the feed chute 17 is equal to the combined entrance area of the pockets, and the height and width of the feed chute is approximately equal to the diameter and twice the height, respectively, of a single can. The length of the periphery of the feed chute is accordingly approximately twice the diameter of a can plus four times the height of a can.

For a given can size, e.g., a standard size can with a diameter of 3 7/16 inches and a height of 1 3/16 inches into which is to be packed a fish cake in the order of 3 inches in diameter and 1¼ inches high (depending on the requirements of the individual canner), the present chute will have twice the cross-sectional area but only about a 30% longer periphery than a prior art feed chute used for a single pocket and can. This is a matter of significance since when fish loins are closely compacted in the chute by the ram, considerable force is required to push the fish through the chute because the drag resulting from the frictional resistance between the fish loins and the walls of the chute. The frictional resistance is, in general, directly proportional to the length of the periphery of the chute.

Better weight control and quality of pack are achieved in two ways by the present invention. First of all, the use of a tapered chute enables a greater proportion of the ram force to be used for compression of the fish within a pocket. Thus, when the column of fish has been moved so that the end of the column is in the pocket, ram force will cause the fish to compress in the pocket and to expand outwardly against the walls of the chute. On the next cycle, when the column is to be again advanced, ram force is necessary to overcome the drag force. However, because of the taper of the chute, as soon as the initial drag is overcome, the column of fish advances into an expanded-size chute so that it moves quickly and easily with decreased drag until the end of the fish column enters into the pocket and advance is stopped thereby. The ram force will now compress the fish in the pocket. The column again is expanded outwardly to the chute walls but there is little movement of the fish along the chute at such time and thus little drag resistance to overcome.

Secondly, the large cross-sectional area of the present chute contributes substantially to better weight and quality control. As brought out above, for a standard-size can, the length of the chute periphery, and the drag resistance is about 30% greater in the present chute as compared to the previous chute. At the same time, the ram force on the end of the column of loins is distributed over twice the area. As a result, for a given total ram force, the pressure per unit area on the column of loins in the present chute will be about half of that in the previous chute. As a consequence, if the total ram force in the present invention is increased by 30% to overcome the 30% increase in drag resistance with the same effectiveness as before, the pressure per unit area on the fish column will be only about 65% of that in the previous chute. If the total ram force is increased by 50%, to provide an even more effective overcoming of drag resistance, the pressure per unit area on the fish column will still be only about 75% as compared to before. The lower pressure per unit area will result in less fluid squeeze-out and less damage to the fish. Additionally, the lower pressure per unit results in a lower force causing the column of fish to expand outwardly so that there is less drag to overcome.

The reduced pressure per unit area on the end of the fish column has a further advantage in that with less pressure there is less tendency of the end of the fish column to stick to the ram and thus there is less fish pull-out on the back stroke of the ram. Such pull-out is of course undesirable since it breaks up the loins and detracts from their appearance. The tapering of the chute also assists in preventing fish pull-out since the tapered walls support the fish column against backward movement into a smaller cross-sectional area.

With lesser force per unit area exerted by the ram, the density of the fish within the pockets will be somewhat less than before. To compensate for this, the volume control cams 67 and 72 are adjusted to increase the volume of the pockets so that there will be sufficient volume of the less densely compacted fish to give the weight desired in the pockets.

Although the particular embodiment of the invention herein shown and described has three pockets on turret 11 and six pockets on turret 12, it is to be realized that a lesser or greater number could be used. As, for example, turret 11 could have two pockets and turret 12 could have four pockets. In such case, in one cycle of operation, turret 12 would be rotated 90° to a second station 20 while turret 11 would be rotated 180° to a third station 24, such rotation providing for the necessary disalignment of the filled pockets while simultaneously bringing empty pockets to the feed station for filling. Or, turret 11 could have four pockets and turret 12 could have eight pockets. In one cycle of operation, turret 12 would be rotated 45° while turret 11 is rotated 90°, misaligning the filled pockets and bringing empty pockets to the feed station. Decreasing the number of pockets will add, however, to the time in the cycle required for turret rotation. Increasing the number of pockets will decrease the time required for rotation but the closer spacing of the operating stations will require more design effort to fit the operating parts closer together.

We claim:

1. Fish-canning apparatus comprising:
(a) first and second movable members each having a fish-receiving and forming pocket formed into a surface thereof;
(b) first, second and third spaced-apart operational stations adjacent the path of movement of said movable members, said movable members being positionable adjacent each other at said first station with said pockets thereof in alignment with each other to form a single combined pocket;
(c) means at said first station for filling both of said pockets simultaneously with a single slug of fish;
(d) means operatively associated with said movable members for moving said movable members and for moving said members relative to each other to move the pocket of said first member from said first station to said second station and for moving said pocket of said second member from said first station to said third station;
(e) means operatively associated with said movable members for severing said slug of fish in said pockets crosswise thereto and between said pockets after said slug is filled into said pocket and before relative movement of said movable members;
(f) forming means at said second and third stations movable laterally into the pockets of said movable members thereat for forming the severed fish slugs in said pockets into desired shapes; and
(g) plunger means at said second and third stations movable lengthwise into the pockets of said movable members thereat for ejecting formed fish slugs lengthwise from said pockets.

2. Fish-canning apparatus as set forth in claim 1, wherein said first station means (c) comprises an enclosed feed chute having a delivery passage therethrough with a discharge end having a cross-sectional area and configuration substantially the same as that of the combined and aligned pockets of said first and second movable members presented to the discharge end of said feed chute at said first station, means operatively associated with said feed chute for feeding fish into said feed chute at a feed point spaced from the discharge end thereof and a reciprocal ram means within said feed chute for forcing fish fed thereinto from said feed point toward said discharge end and into said pockets.

3. Fish-canning apparatus as set forth in claim 2, wherein said feed chute is shaped to provide an increasing cross-sectional area from said feed point towards said discharge end thereof.

4. Fish-canning apparatus as set forth in claim 2 and further including means operatively associated with said ram for moving said ram under constant force towards said discharge end of said chute.

5. Fish-canning apparatus as set forth in claim 4, wherein said feed chute is shaped to provide an increasing cross-sectional area from said feed point towards said discharge end thereof.

6. Fish-canning apparatus as set forth in claim 1, wherein said means (d) is operable to move said first and second movable members simultaneously with and adjacent to each other prior to moving them relative to each other, and wherein said means (e) is operable to sever said slug during such simultaneous movement of said movable members.

7. Fish-canning apparatus comprising:
(a) first and second turrets adjacent each other and rotatable about a common axis, each turret having a fish-receiving and forming pocket therewithin which extends through said turret from a side thereof and a pocket entrance through the periphery of said turret into said pocket;
(b) first, second and third spaced-apart operational stations adjacent the periphery of said turrets, said turrets being positionable at said first station with said pockets and pocket entrances being in alignment with each other.
(c) means at said first station for filling both of said pockets simultaneously with a single slug of fish;
(d) means operatively associated with said turrets for rotating said turrets and for rotating them relative to each other to move the pocket of said first turret from said first station to said second station and to move the pocket of said second turret from said first station to said third station;
(e) means operatively associated with said turrets for severing said slug of fish in a plane normal to said axis and between said pockets after said slug is filled into said pockets and before said turrets are rotated relative to each other;
(f) forming means at said second and third stations movable into the pockets of said first and second turrets respectively through the pocket entrance thereof for forming the severed fish slugs therewithin into desired shapes;
(g) each turret having an opening therethrough in alignment with the pocket of the other turret when said first and second turrets are at said second and third stations respectively; and
(h) plunger means at said second and third stations movable lengthwise through the aligned turret pockets and openings to eject the formed fish charges therefrom.

8. Fish-canning apparatus as set forth in claim 7, wherein said first station means (c) comprises an enclosed feed chute having a delivery passage therethrough with a discharge end having a cross-sectional area and configuration substantially the same as that of the combined and aligned pocket entrances presented to the discharge end of said chute at said first station, means operatively associated with said chute for feeding fish into said chute at a feed point spaced from the discharge end thereof, and a reciprocal ram means within said chute for forcing fish fed thereinto from said feed point towards said discharge end and into said turret pockets.

9. Fish-canning apparatus as set forth in claim 8, wherein said feed chute is shaped to provide an increasing cross-sectional area from said feed point towards said discharge end thereof.

10. Fish-canning apparatus as set forth in claim 8 and further including means operatively associated with said ram for moving said ram under constant force towards said discharge end of said chute.

11. Fish-canning apparatus as set forth in claim 10, wherein said feed chute is shaped to provide an increasing cross-sectional area from said feed point towards said discharge end thereof.

12. Fish-canning apparatus as set forth in claim 7, wherein said means (d) is operable to rotate said turrets to move said pockets simultaneously and in alignment with each other from said first station to said second station, and wherein said means (e) is operable to sever said slug during said simultaneous movement of said pockets from said first station to said second station.

13. Fish-canning apparatus as set forth in claim 7, wherein each of said turrets has a plurality of equidistantly spaced-apart fish-receiving and forming pockets, each pocket extending through its turret from side to side thereof and having a pocket entrance through the periphery of its turret, wherein said first turret has a greater number of pockets than said second turret and said second turret has openings therethrough alignable with selected of said first turret pockets, and wherein said first, second and third stations are spaced apart from each other such that when pockets of said first and second turrets are aligned with each other adjacent said first station other pockets of said first and second turrets are adjacent said second and third stations respectively.

14. Fish-canning apparatus as set forth in claim 13, wherein said first station means (c) comprises an enclosed feed chute having a delivery passage therethrough with a discharge end having a cross-sectional area and configuration substantially the same as that of the combined and aligned pocket entrances presented to the discharge end of said feed chute at said first station, means operatively associated with said chute for feeding fish into said chute at a feed-point spaced from the discharge end thereof, and a reciprocal ram means within said chute for forcing fish fed thereinto from said feed-point toward said discharge end and into said turret pockets.

15. Fish-canning apparatus as set forth in claim 14, wherein said feed chute is shaped to provide an increasing cross-sectional area from said feed point towards said discharge end thereof.

16. Fish-canning apparatus as set forth in claim 14 and further including means operatively associated with said ram for moving said ram under constant force towards said discharge end of said chute.

17. Fish-canning apparatus as set forth in claim 16, wherein said feed chute is shaped to provide an increasing cross-sectional area from said feed point towards said discharge end thereof.

18. Fish-canning apparatus as set forth in claim 13, wherein said means (d) is operable to rotate said turrets to move said pockets simultaneously and in alignment with each other from said first station to said second station, and wherein said means (e) is operable to sever said slug during said simultaneous movement of said pockets from said first station to said second station.

19. Fish-canning apparatus as set forth in claim 13, wherein said means (d) is operable to rotate said turrets in unison to move the turret pockets from said first station to said second station and is thereafter operable to rotate said second turret to move the pocket thereof from said second station to said third station while said first turret remains stationary.

20. Fish-canning apparatus as set forth in claim 13, wherein said first turret has an even number of fish-receiving and forming pockets and wherein said second turret has half as many fish-receiving and forming pockets and has one of said openings between each pair of its pockets.

21. Fish-canning apparatus as set forth in claim 20, wherein said second turret has at least three fish-receiving and forming pockets, wherein said apparatus has a fourth operation station adjacent the side entrance of a second turret pocket when other second turret pockets are at said first and third stations and further including means at said fourth station insertable into the pocket entrance of the turret pockets thereat for locking said turrets against rotation.

22. In fish-canning apparatus:

(a) first and second members each having a fish-receiving pocket therein and an entrance into the pocket, said members being positionable to align said pockets and entrances and form a single combined pocket with a combined and unobstructed entrance thereinto;

(b) an enclosed chute having a delivery passage therethrough terminating adjacent the combined pocket entrance, the cross-sectional area of said delivery passage at said combined pocket entrance being substantially the same as that of said combined pocket entrance;

(c) means operatively associated with said chute for feeding fish into said chute at a feed point spaced from said combined pocket entrance;

(d) a ram movable within said chute for forcing fish within said chute through said delivery passage from said feed point and simultaneously into both parts of said combined pocket;

(e) first knife means operatively associated with said chute and said first and second members for severing the fish between said combined pocket entrance and said chute; and (f) second knife means operatively associated with said first and second means and movable relative to and between said first and second members for severing the fish within said combined pocket.

23. In a fish-canning apparatus as set forth in claim 22, wherein said chute is shaped to provide an increasing cross-sectional area from said feed point towards said combined pocket entrance.

24. In a fish-canning apparatus:

(a) an elongated, tubular feed chute having an open discharge end and a side entrance thereinto spaced from said discharge end;

(b) conveyor belt means adjacent said feed chute for intermittently conveying fish horizontally into said chute through said side entrance;

(c) vertically movable tamper means operatively associated with said feed chute and having a lower surface spaced above the bottom of said side entrance and extending horizontally and transversely from adjacent said side entrance;

(d) knife means operatively associated with said feed chute and movable across said side opening for severing fish fed into sand feed chute by said conveyor belt means and for closing said side entrance and removable from said side entrance to open said side entrance;

(e) a reciprocating ram mounted in said feed chute for movement back and forth past said side entrance;

(f) means operatively associated with said tamper means for moving said tamper means between upper and lower positions;

(g) means operatively associated with said knife means for moving said knife means to close said side entrance when said tamper means is in its lower position and for moving said knife means to open said side entrance when said tamper means is in its upper position;

(h) means operatively associated with said ram for moving said ram past said side entrance and towards said discharge end when said side entrance is closed by said knife means;

(i) means operatively associated with said conveyor belt for moving said conveyor belt means to convey fish into said chute when said side entrance is open and said tamper means is in its upper position.

25. Apparatus as set forth in claim 24, wherein said tamper means includes a portion extending transversely from said side entrance away from said chute to overlie said conveyor belt means.

26. Apparatus as set forth in claim 24, wherein said tamper means includes a portion extending transversely from said side entrance and forming the top of said chute adjacent said side entrance.

27. Apparatus as set forth in claim 24, wherein said tamper means comprises a first portion extending transversely from said side entrance and forming the top of said chute adjacent said side entrance and a second portion extending transversely from said side entrance away from said chute to overlie said conveyor belt means and means connecting said first and second tamper means portions for unitary vertical movement thereof.

28. Apparatus as set forth in claim 27, wherein said first and second portions of said tamper means are spaced horizontally from each other to form a slot therebetween through which said knife means is movable.

29. Apparatus as set forth in claim 27, wherein the bottom surface of said first tamper portion is vertically above the bottom surface of said second tamper portion.

30. Apparatus as set forth in claim 29, wherein the bottom surface of said first tamper portion is below the upper surface of said chute adjacent said first tamper portion when said tamper means has been moved to its lower position.

31. In a fish-canning apparatus:

(a) means forming a fish-receiving and forming pocket having a pocket entrance thereinto;

(b) an elongated and enclosed feed chute having a discharge end positioned adjacent said pocket entrance and a side opening thereinto spaced from said discharge end, said feed chute being tapered to provide an increasing cross-sectional area from said side opening toward said discharge end;

(c) conveyor belt means adjacent said feed chute for intermittently conveying fish horizontally into said chute through said side opening;

(d) knife means operatively associated with said feed chute and movable across said side opening for severing fish fed into said feed chute by said conveyor belt means and for closing said side opening;

(e) a reciprocal ram mounted in said feed chute for intermittent movement back and forth past said side opening;

(f) means operatively associated with said knife means for moving said knife means upwardly to open said side opening and for moving said knife means downwardly to close said opening;

(g) means operatively associated with said conveyor belt for actuating said conveyor belt means to convey fish into said chute when said side opening is open; and (h) means operatively associated with said ram for moving said ram past said side opening and towards said discharge end when said knife means has been moved to close said lateral opening.

* * * * *